US006025802A

United States Patent [19]

Eggleston et al.

[11] Patent Number: 6,025,802

[45] **Date of Patent: *Feb. 15, 2000**

[54] ANTENNA FOR MOBILE COMMUNICATIONS DEVICE

[75] Inventors: Steve W Eggleston; Ken Sung, both of San Diego, Calif.

[73] Assignee: Nokia Mobile Phones Limited, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 09/039,784

[22] Filed: Mar. 16, 1998

Related U.S. Application Data

[63] Continuation of application No. 09/005,103, Jan. 9, 1998.

[51] Int. Cl.[7] ..... H01Q 1/38; H01Q 1/24

[52] U.S. Cl. ..... 343/700 MS; 343/702

[58] Field of Search ..... 343/700 MS, 702, 343/767, 795; H01Q 1/38, 1/24

[56] References Cited

U.S. PATENT DOCUMENTS

| | | | |
|---|---|---|---|
| 4,692,769 | 9/1987 | Gegan | 343/700 MS |
| 4,980,694 | 12/1990 | Hines | 343/702 |
| 5,216,430 | 6/1993 | Rahm et al. | 343/700 MS |
| 5,680,144 | 10/1997 | Sanad | 343/700 MS |
| 5,835,063 | 10/1998 | Brachat er al. | 343/700 MS |

FOREIGN PATENT DOCUMENTS

| | | |
|---|---|---|
| 0642190 | 3/1995 | European Pat. Off. . |
| 0714151 | 5/1995 | European Pat. Off. . |
| WO95/24745 | 9/1995 | WIPO . |

*Primary Examiner*—Hoanganh Le
*Assistant Examiner*—Shih-Chao Chen
*Attorney, Agent, or Firm*—Brian T. Rivers

[57] ABSTRACT

A new category of mobile communications antenna is implemented in a single layer of conducting material. Wire-slot sections, including wire-tabs defining slots in the material, partially extend around the perimeter of at least one patch-tab section of the antenna. The perimeter of the at least one patch-tab section forms one edge of each slot, and the wire-tab of a wire-slot section forms a second edge of the slot. The wire-tabs of the wire-slot sections are separated from the patch-tab section by the slots and merge into the patch-tab section at a desired point. The length of each of the wire-slot sections may vary. A portion of each of a pair of the wire-tabs of the wire-slot sections functions as an input feed. The patch-tab section may be implemented as a single tab or as a plurality of tabs separated from one another by a slot. By varying the relative geometries of the patch-tab, wire-slots and tabs of the wire-slots, the electrical properties of the antenna, including the input impedance, can be adjusted.

10 Claims, 5 Drawing Sheets

ANTENNA FOR MOBILE COMMUNICATIONS DEVICE

This application is a continuation of U.S. application Ser. No. 09/005,103, filed Jan. 9, 1998, pending.

FIELD OF THE INVENTION

This invention relates generally to antennas and, more particularly, to compact, lightweight antennas for mobile communications devices.

BACKGROUND OF THE INVENTION

As electronics and communications technology has advanced, mobile communications devices have become increasingly smaller in size. Mobile communications devices offering compact size and light weight, such as a cellular phone that can be carried in a pocket, have become commonplace. Concurrently, the increase in the sophistication of device performance and services offered has kept pace with the reduction in size and weight of these devices. It has been a general design goal to further reduce size and weight and increase performance at the same time.

Having compact size and light weight in combination with increased sophistication of performance as a design goal for a communications device presents challenges in all aspects of the design process. One area in which size and weight design goals may be counter to performance design goals is in the area of antenna design. Antenna design is based on manipulating the physical configuration of an antenna in order to adjust performance parameters. Parameters such as gain, specific absorption ratio (SAR), and input impedance may be adjusted by modifying various aspects of the physical configuration of an antenna. When constraints are externally set, such as when attempting to design an antenna for a mobile communications device having reduced size and weight, the design process becomes difficult.

The most common antenna used for mobile communications devices such as mobile phones is a quarter wave whip antenna which typically extends vertically from the top of the device and radiates in a donut-shaped pattern. The quarter wave whip antenna provides good performance relative to cost. Also, the quarter wave whip antenna can easily be designed having the standard input impedance of approximately 50 ohms for matching coupling to a mobile device.

As mobile communications devices decrease in size and weight, use of whip antennas may become increasingly inconvenient. Generally, the gain of an antenna is proportional to the effective cross-sectional area of the antenna. Decreasing the size of a whip antenna decreases the antenna gain. Alternative antenna designs suffer from the same shortcoming as size decreases. Additionally, smaller size, external antennas are more fragile and prone to breakage and, as devices become smaller and smaller, it may be desirable to design devices in which no external antenna is visible and protruding. An antenna internal to the device would be desirable in this case.

Because of the geometry and size of new mobile communications products, it is difficult to design an internal antenna that offers performance comparable to that offered by a whip antenna. It is even more difficult to design an internal antenna that provides improved performance over a whip, while not increasing the cost of the antenna.

OBJECTS OF THE INVENTION

It is therefore an object of this invention to provide an improved antenna for a mobile communications device that overcomes the foregoing and other problems.

Another object and advantage of this invention is to provide an antenna for a mobile communications device that may be configured and hidden within the device, preventing the problems that occur when using external antennas.

It is a further object and advantage of this invention to provide an antenna for a mobile communications device that may be configured internally in the device, while providing comparable or improved performance as compared to conventional antennas used on mobile communications devices.

A further object and advantage of this invention is to provide an antenna for a mobile communications device that may be inexpensively manufactured and inexpensively configured internally within the device.

SUMMARY OF THE INVENTION

The present invention provides an antenna that utilizes a combined patch-tab and wire-slot configuration. The antenna is especially suited for use in a mobile communications device and may be configured and hidden internally within the device, while providing comparable or improved performance as compared to conventional antennas used on mobile communications devices. The antenna is also less expensive as compared to conventional antennas used on communications devices. The antenna is simple in design and may be inexpensively manufactured. The design of the antenna also allows the antenna to be inexpensively configured internally within the device during manufacture.

The antenna is implemented in a single layer of conducting material. Wire-slot sections, including wire-tabs defining slots in the materials, partially extend around the perimeter of at least one patch-tab section of the antenna. The perimeter of at least one patch-tab section forms one edge of each slot, and the wire-tab of a wire-slot section forms a second edge of the slot. The wire-tabs of the wire-slot sections are separated from the patch-tab section by the slots and merge into the patch-tab section at a desired point. The length of each of the wire-slot sections may vary. A portion of each of a pair of the wire-tabs of the wire-slot sections functions as an input feed. The patch-tab section may be implemented as a single tab or as a plurality of tabs separated from one another by a slot. By varying the relative geometries of the patch-tab, wire-slots and tabs of the wire-slots, the electrical properties of the antenna, including the input impedance, can be adjusted. The capacitance of the patch-tabs and wire-slots may be reduced in area to reduce the capacitance for adjusting the input impedance. The slots may be enlarged to improve antenna gain. The antenna allows a nonsymmetrical design that can be used to enable a conformal fit within a communications device.

The antenna is able to provide a higher gain than the conventional whip antenna that is commonly used in mobile communications devices. The antenna may be easily configured to provide the standard 50 ohm input impedance for mobile communications devices, such as a mobile phone.

In an embodiment of the invention, the antenna is implemented into a single layer of conducting material as a combined patch-tab and wire-slot configuration. The combined patch-tab and wire-slot configuration implements a closed loop design, with the wire-slot sections extending partially around the perimeter of the patch-tab section. The antenna has outer dimensions that allow it to be placed within a small space inside the cover of a mobile communications device. In the embodiment of the invention, the antenna is configured to be placed within the back upperside cover of a mobile phone, so that the antenna is completely internal to the mobile phone when the cover is assembled.

The layer of the antenna may be separated from a ground plane by using a spacer of appropriate dimensions and material, so that desired electrical properties are obtained. The ground plane may be placed directly on the spacer. Twin input feeds, one on each of the wire-tabs of the wire-slot sections, provide the input, with one feed connecting to the circuitry of the mobile phone and the other feed connecting to the ground plane when the antenna, spacer and ground plane are assembled. The antenna of the embodiment is implemented to have a 50 ohm input impedance at the input feeds.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1B:
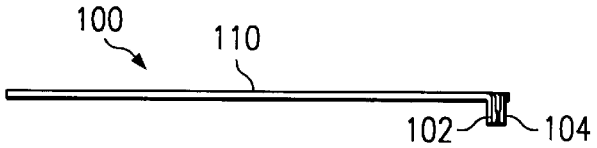
FIGS. 1A, 1B, and 1C are front, top, and right plan views, respectively, of an antenna constructed according to the teachings of the invention.
Figure 1A:
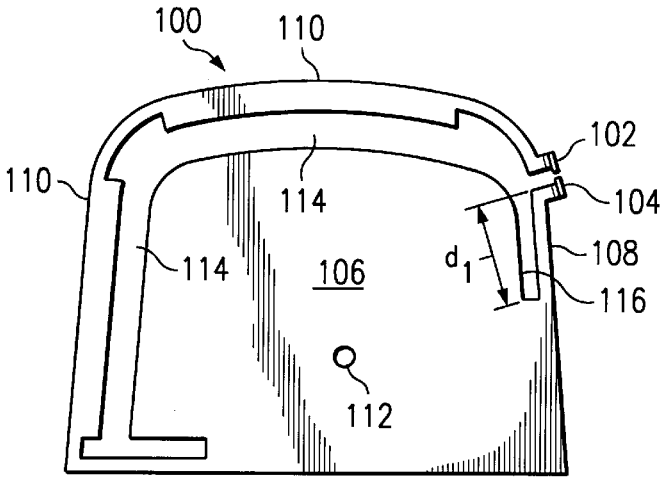
Figure 1C:
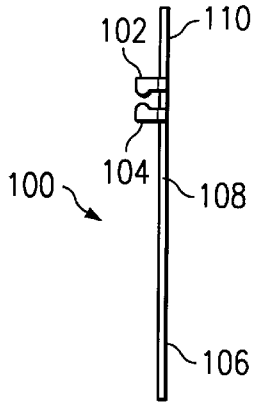

Referring now to FIGS. 1A, 1B, and 1C, therein are front, top, and right plan views, respectively, of an embodiment of an antenna constructed according to the teachings of the invention. Antenna 100 is constructed in a single sheet of conducting material and comprises a patch-tab section 106 and wire-slot sections formed from wire-tabs 110 and 108. Patch-tab section 106 is generally defined at the bottom and partially on the right by the contiguous area extending to the borders adjacent to the lower right-hand corner of antenna 100, and on the left and top by the slots 114 and 116 formed between wire-tabs 110 and 108, respectively, and patch-tab 106. Terminal 102 provides an input feed to wire-tab 110. Terminal 104 provides an input feed to wire-tab 108. The configuration of antenna 100 provides a patch-tab wire-slot combination antenna, the properties of which may be varied by changing the relative physical dimensions shown in FIG. 1. In the embodiment, antenna 100 is constructed out of copper. In other embodiments, it is also possible to construct antenna 100 out of any other suitable material, such as, for example, aluminum, zinc, iron or magnesium.

The configuration of antenna 100 allows the use of adjustments of the capacitances of wire-tabs 108 and 110 and patch-tab 106 to match the 50 ohm input impedance of a standard mobile telephone. Antenna 100 may be tuned by increasing or decreasing the length d1 of slot 116. Increasing the length lowers the resonant frequency and decreasing the length increases the resonant frequency. Finer tuning can be accomplished by adjusting the relative dimensions of wire-tabs 108 and 110, slot 114 and patch-tab 106. Antenna 100 may be configured to resonate at frequencies down to 750 MHz and may be configured to have a frequency range within the cellular frequency bands. For example, antenna 100 could have a frequency range of 824 MHz–894 MHz for cellular frequencies. The capacitances of wire-tabs 108 and 110 and patch-tab 106 also allow antenna 100 to be configured using a relatively small size, having a 50 ohm input impedance, that is suitable for mobile communication device applications. The nonsymmetrical geometry of the design allows a corner feed at terminals 102 and 104, and a shape providing a conformal fit into spaces suitable for the location of a mobile communication device internal antenna. A conventional loop antenna having the same parameters would be much larger.

The circular closed loop design causes magnetic reactive fields from opposite sides of the antenna to partially cancel in the near field. The slots 114 and 116 each have counter currents on opposite sides, which also result in partial cancellation of fields in the near field. The partial cancellation of fields in the near field produces a higher operational gain from a lower specific absorption ratio (SAR). The lower SAR is caused by the partial cancellation in the near fields.

Figure 4B:
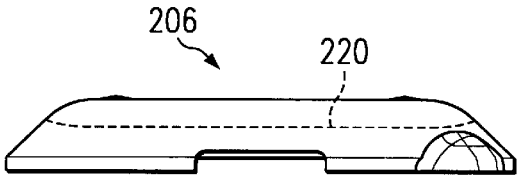
FIGS. 4A, 4B, and 4C are front, top, and right plan views, respectively, of the cover of the antenna assembly of FIG. 2.
Figure 4A:
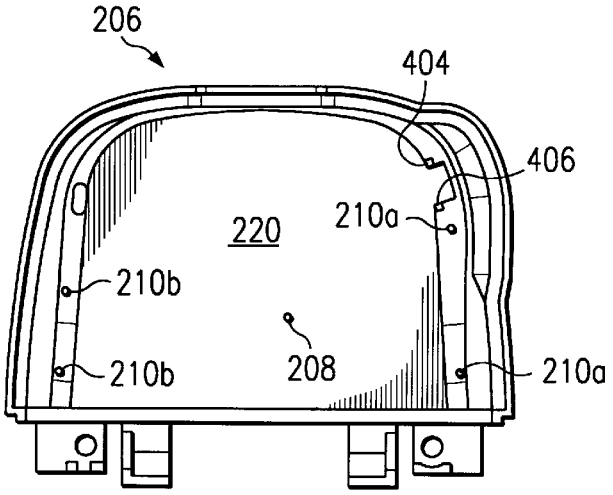
Figure 4C:
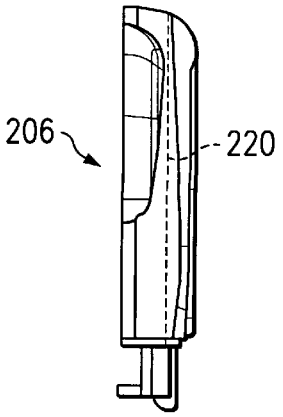
Figure 2:
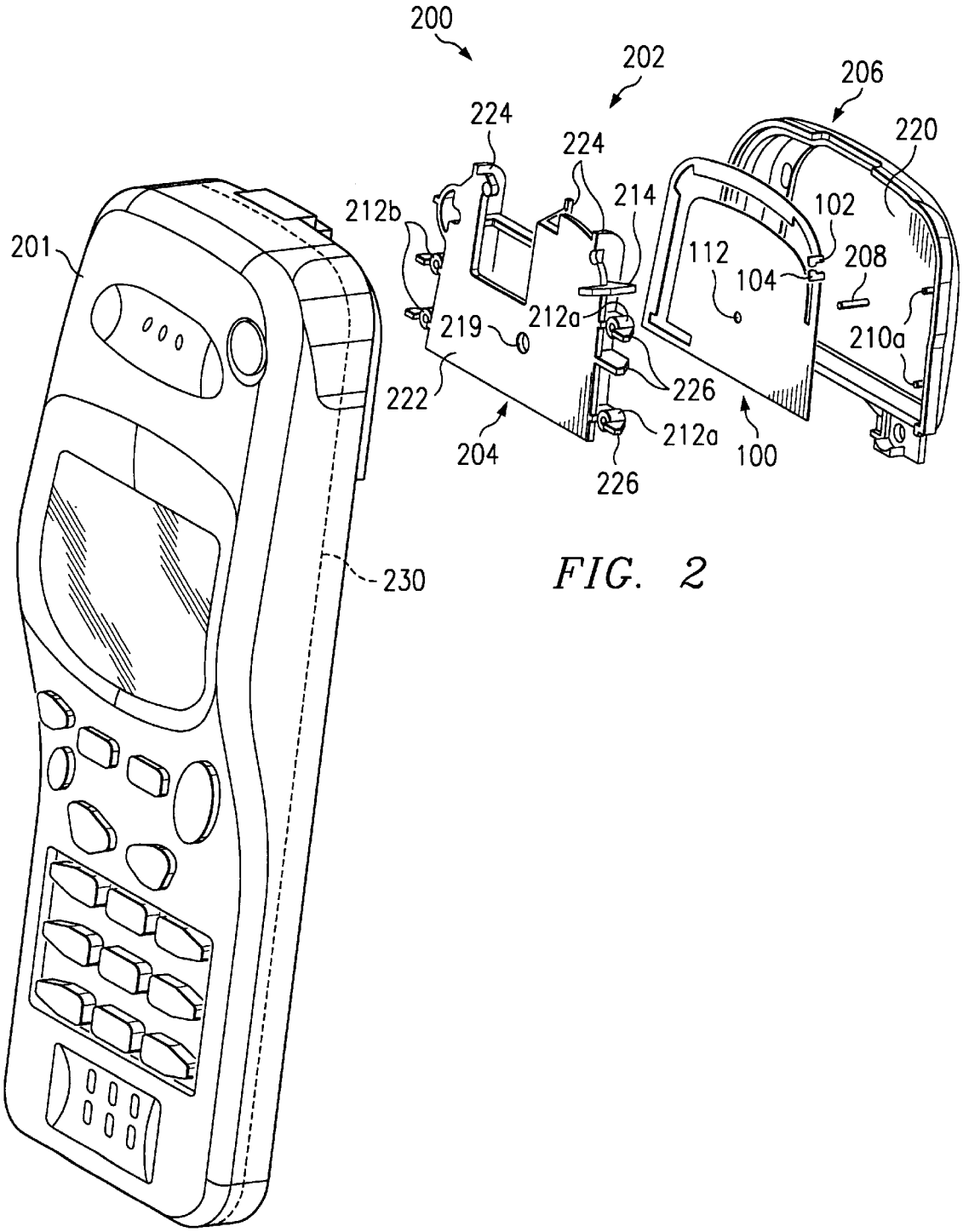
FIG. 2 is an exploded top-right front perspective view of a mobile telephone into which the antenna of FIG. 1 may be implemented.
Figure 3B:
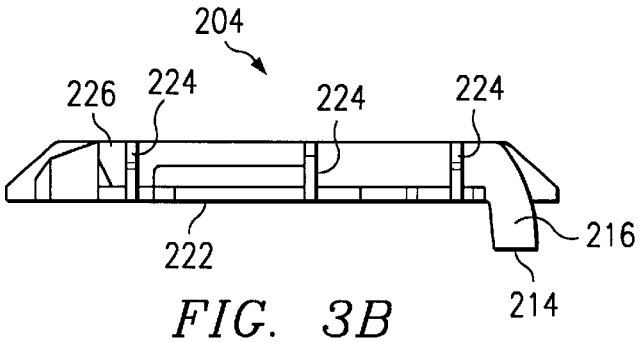
FIGS. 3A, 3B, 3C, and 3D are front, top, right, and rear plan views, respectively, of the ground plane-spacer portion of the antenna assembly of FIG. 2.
Figure 3A:
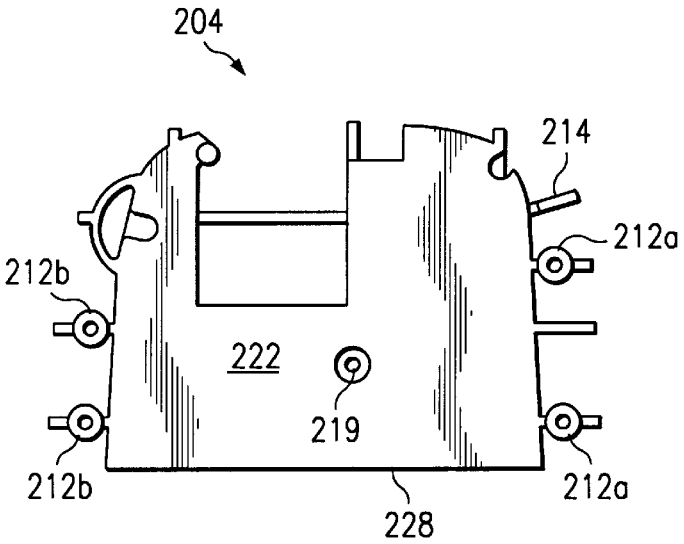
Figure 3C:
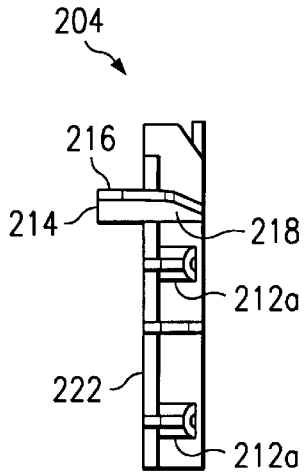
Figure 3D:
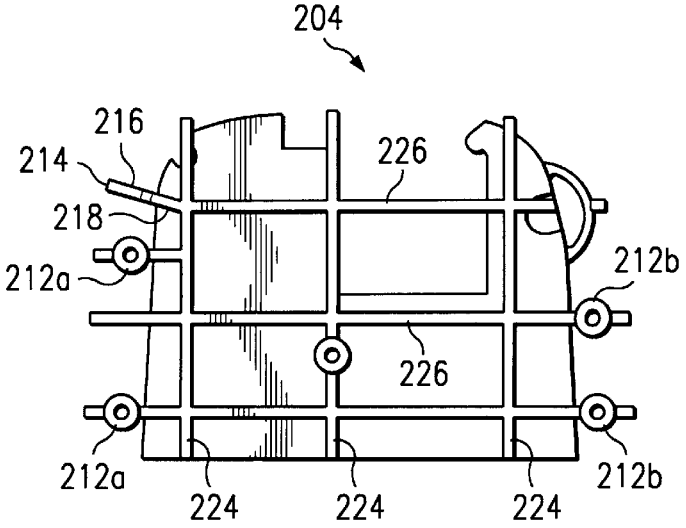

Referring now to FIG. 2, therein is an exploded top-right front perspective view of a mobile telephone into which the antenna of FIG. 1 may be implemented. Mobile telephone 200 comprises body 201 and antenna assembly 202. Antenna assembly 202 comprises antenna 100, ground plane-spacer 204, and cover 206. Mobile telephone 200 comprises a mounting board 230, shown by dotted line, for mounting antenna assembly 202. Antenna 100 is as described for FIG. 1. FIGS. 3A, 3B, 3C, and 3D are front, top, right and rear plan views, respectively, of the ground plane-spacer portion 204 of the antenna assembly 202 of FIG. 2. Ground plane-spacer 204 comprises mounting holes 219, 212*a* and 212*b*, antenna connector 214, spacing bars 224 and 226, and ground plane 222. Antenna connector 214 has a conducting surface 216 covering a first side of antenna connector 214. Conducting surface 216 is isolated and separate from ground plane 222. Antenna connector 214 also has a conducting surface 218 that covers a second side of antenna connector 214 and that is electrically connected to ground plane 222. FIGS. 4A, 4B and 4C are front, top, and right plan views, respectively, of the cover 206 of the antenna assembly 202 of FIG. 2. Cover 206 comprises mounting pins 208, 210*a* and 210*b*, recess 220 and recess pins 404 and 406. In assembly, antenna 100 fits flush within recess 220 of cover 206. Pin 208 is inserted into hole 112 of antenna 100, and terminals 102 and 104 are retained within recess pins 404 and 406, respectively. Ground plane-spacer 204 is then placed into cover 206, with side pins 210*a* and side pins 210*b* of cover 206 engaging holes 212*a* and 212*b*, respectively, in spacer 204. Hole 219 of spacer 204 also engages pin 208 of cover 206. Terminals 102 and 104 of antenna 100 make contact and create an electrical connection with opposite conducting surfaces 216 and 218, respectively, of antenna connector 214. An electrical connection is then made from terminal 104 to ground plane 222 through conducting surface 218. Once assembled, the antenna assembly 202 can be inserted into the top rear section of mobile telephone 201, onto mounting board 230.

Figure 5:
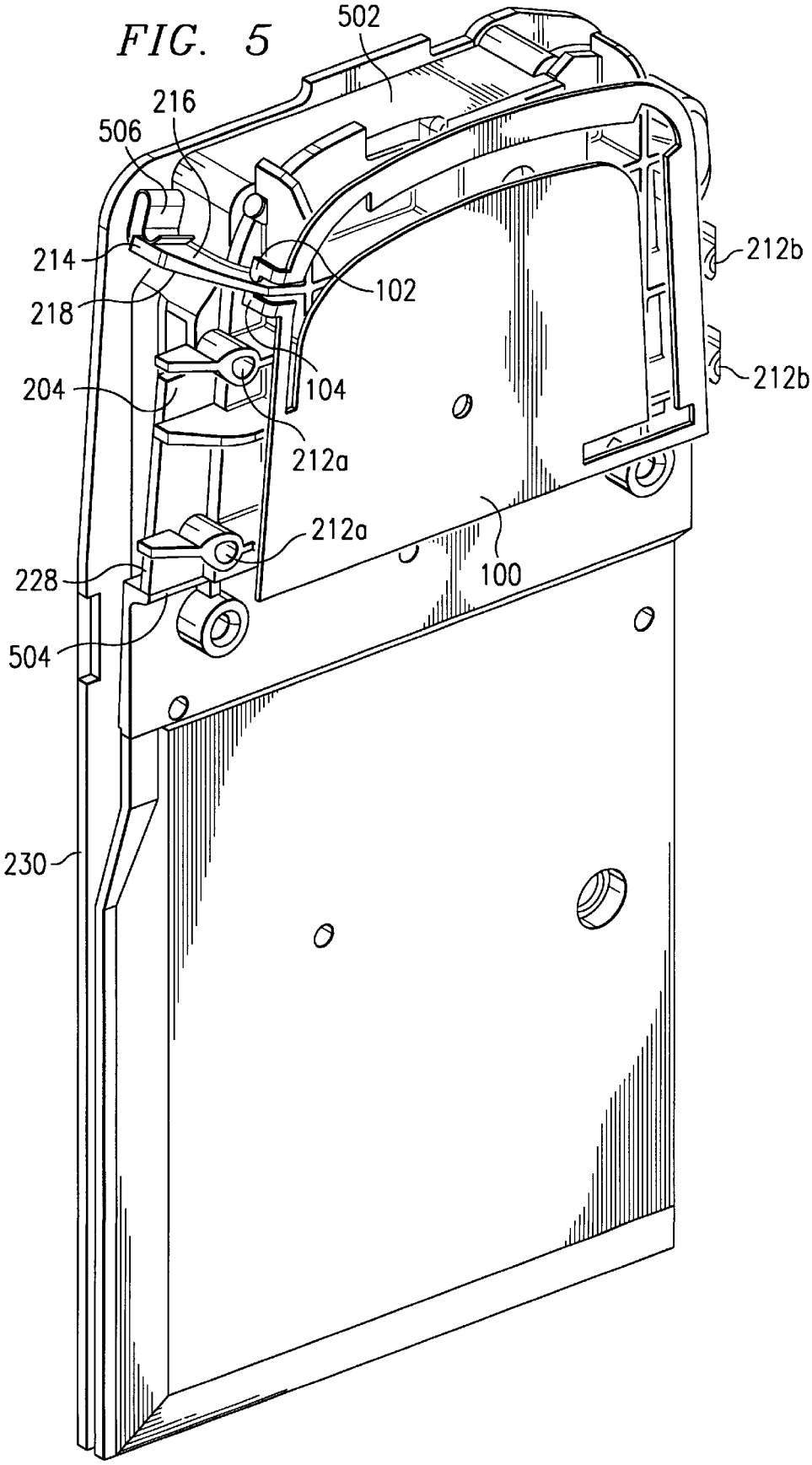
FIG. 5 is a top-left rear perspective view showing the mounting of the antenna and ground plane-spacer of the antenna assembly of FIG. 2 on a circuit board within the mobile telephone.

Referring now to FIG. 5, therein is a top-left rear perspective view showing the mounting of antenna 100 and ground plane-spacer 204 of antenna assembly 202 on mounting board 230. In FIG. 5, the mounting board 230 and antenna assembly 202 have been removed from within mobile telephone 201. Mounting board 230 comprises an electrical connector 506 and a first section 502 that is formed to engage ground plane-spacer 204, when antenna assembly 202 is placed on mounting board 230. Mounting board 230 also comprises a second section 504 that is formed so that the bottom edge 228 of ground plane-spacer 204 rests on second section 504, when antenna assembly 202 is placed on mounting board 230.

Electrical connection is made from terminal 104 of antenna 100 to ground plane 222, through conducting surface 218 of antenna connector 214, as described above. Electrical connection from terminal 102 of antenna 100 to mounting board 230 is made through conducting surface 216 to electrical connector 506. Electrical connector 506 may be connected to the appropriate circuitry for receiving a signal from antenna 100 for processing or for feeding a signal to antenna 100 for transmission.

By modifying the basic patch-tab and wire-slot configuration, other embodiments are also possible.

Figure 6:
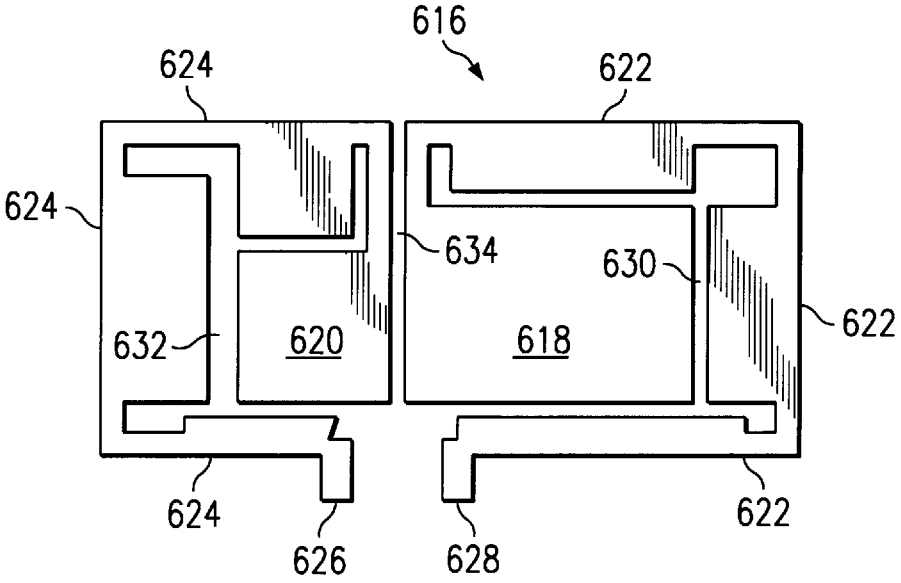
FIG. 6 is a front plan view of an alternative embodiment open antenna constructed according to the teachings of the invention.

Referring now to FIG. 6, therein a front plan view of alternative embodiment open antenna constructed according to the teachings of the invention. FIG. 6 shows a patch-tab and wire-slot antenna modified to perform as a patch-tab dipole antenna. Antenna 616 comprises two patch-tab sections 618 and 620. Patch-tab sections 618 and 620 form slots 630 and 632, respectively, with wire-tab sections 622 and 624, respectively. Terminals 626 and 628 provide signal feed from and to wire-tabs 624 and 622, respectively. The placement of slot 634 to divide patch-tabs 618 and 620 provides a voltage node so that antenna 616 functions as a patch-tab and wire-slot dipole antenna.

Figure 7:
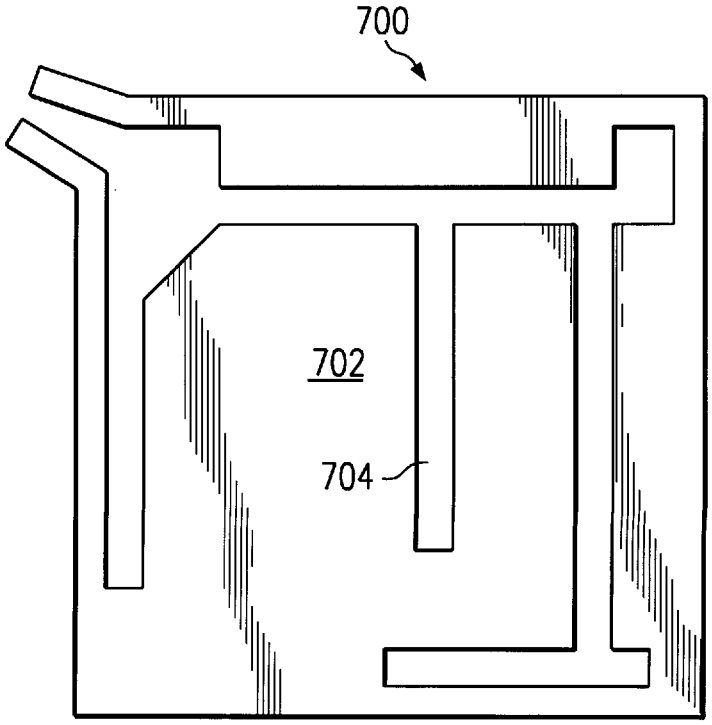
FIG. 7 is a front plan view of an alternative embodiment dual frequency antenna constructed according to the teachings of the invention.

Referring now to FIG. 7, therein is a front plan view of an alternative embodiment dual frequency antenna constructed according to the teachings of the invention. Antenna 700 is configured similarly to antenna 100 of FIG. 1. The addition of slot 704 in patch-tab section 702 introduces an additional voltage node in the antenna as compared to antenna 100. Antenna 700 is configured to resonate within a higher frequency range and a low frequency range. These ranges may be, for example, a high frequency range around the 2 GHz PCS frequencies and a low frequency range around the 900 MHz cellular frequency. Antenna 700 could then be used in a dual mode PCS/cellular mobile telephone.

Although described in the context of particular embodiments, it will be realized that a number of modifications to these teachings may occur to one skilled in the art. Thus, while the invention has been particularly shown and described with respect to specific embodiments thereof, it will be understood by those skilled in the art that changes in form and shape may be made therein without departing from the scope and spirit of the invention.

What is claimed is:

1. An antenna assembly for use in a mobile communications device, said antenna assembly comprising:

a spacer having a first and a second surface and a side;

an antenna comprising a combined patch-tab and wire-slot configuration having an edge and a first and a second terminal, said first and said second terminal each mounted on said edge of said antenna, said antenna in sheet form and mounted on said first surface of said spacer, wherein said first and said second terminals extend outward from said antenna along the side of said spacer; and a ground plane, said ground plane in sheet form and mounted on said second surface of said spacer, wherein said ground plane is disposed in a spaced-apart manner from said antenna, and said first terminal is electrically connected to said ground plane providing electrical connection between said ground plane and said antenna, and wherein said second terminal provides a signal feed for said antenna.

2. The antenna of claim 1, wherein said antenna comprises at least one patch-tab section wherein each of said at least one patch-tab section is formed of a separate sheet of conducting material;

a plurality of wire-tab sections, each of said plurality of wire-tab sections formed in a contiguous sheet of conducting material with a selected at least one patch-tab section of said at least one patch-tab section and extending outward from and partially around the perimeter of said selected patch-tab section defining a slot in said antenna; and wherein said first and said second terminals are formed on a first and a second wire-tab, respectively, of said plurality of wire-tab sections.

3. The antenna assembly of claim 1, wherein said antenna has a first and a second surface and wherein said first surface of said antenna is mounted on said first surface of said spacer, and wherein said antenna assembly further comprises a cover having a first and a second surface, said first surface of said cover having a recess for receiving said second surface of said antenna and said second surface of said cover comprising an external surface of the mobile communications device.

4. The antenna assembly of claim 3, wherein said cover comprises at least a portion of a cover of a mobile telephone.

5. The antenna assembly of claim 1, wherein said spacer further comprises a connector having a first and a second conducting surface, said first conducting surface being electrically connected to said ground plane, and wherein said connector is mounted on said side of said spacer and extends outward in direction in relation to said first surface of said spacer, said first conducting surface of said connector contacting said first terminal and said second conducting surface of said connector contacting said second conducting surface when said antenna is mounted on said spacer, wherein said second terminal provides a signal feed for said antenna.

6. A mobile phone, said mobile phone comprising:

a mounting board having a surface;

a ground plane, said ground plane in sheet form and having a first and a second surface, said first surface of said ground plane mounted on said surface of said mounting board;

a spacer having a first and a second surface and a side, said first surface of said spacer mounted on said second surface of said ground plane; and an antenna having an edge and a first and a second terminal, said first and said second terminal each mounted on said edge of said antenna, said antenna in sheet form and mounted on said second surface of said spacer, wherein said first and said second terminals extend outward from said antenna along the side of said spacer, and said first terminal is electrically connected to said ground plane providing electrical connection between said ground plane and said antenna, and said second terminal provides a signal feed for said antenna.

7. The mobile phone of claim 6, wherein said antenna comprises a combined patch-tab and wire-slot configuration.

8. The mobile phone of claim 6, wherein said antenna has a first and a second surface and wherein said first surface of said antenna is mounted on said second surface of said spacer, and wherein said antenna assembly further comprises a cover having a first and a second surface, said first surface of said cover having a recess for receiving said second surface of said antenna and said second surface of said cover comprising an external surface of the mobile phone.

9. The antenna assembly of claim 6, wherein said spacer further comprises a connector having a first and a second conducting surface, said first conducting surface being electrically connected to said ground plane, and wherein said connector is mounted on said side of said spacer and extends outward in direction in relation to said first surface of said spacer, said first conducting surface of said connector contacting said first terminal and said second conducting surface of said connector contacting said second terminal when said antenna is mounted on said spacer and wherein said second conducting surface provides a signal feed for said antenna.

10. The mobile phone of claim 9, wherein said antenna has a first and a second surface and wherein said first surface of said antenna is mounted on said second surface of said spacer, and wherein said antenna assembly further comprises a cover having a first and a second surface, said first surface of said cover having a recess for receiving said second surface of said antenna and said second surface of said cover comprises an external surface of the mobile phone.

* * * * *